United States Patent [19]

Corna et al.

[11] 4,400,834

[45] Aug. 30, 1983

[54] SWIMMING POOL WALLS WITH GUTTER AND CONDUIT CONSTRUCTION

[75] Inventors: John F. Corna, Columbus; Marcel H. Blais, Westerville, both of Ohio

[73] Assignee: Statewide Pools, Inc., Columbus, Ohio

[21] Appl. No.: 249,748

[22] Filed: Apr. 1, 1981

[51] Int. Cl.[3] ..... E04H 3/16; E04H 3/18

[52] U.S. Cl. ..... 4/506

[58] Field of Search ..... 4/510, 506, 507, 508, 4/511, 512, 513; 52/169.7

[56] References Cited

U.S. PATENT DOCUMENTS

| | | | |
|---|---|---|---|
| 3,890,230 | 6/1975 | Patterson | 4/510 X |
| 4,059,856 | 11/1977 | Patterson | 4/510 X |
| 4,112,526 | 9/1978 | Patterson | 4/510 X |
| 4,121,307 | 10/1978 | Patterson | 4/510 X |
| 4,179,761 | 12/1979 | Corna et al. | 4/510 X |

*Primary Examiner*—Henry K. Artis

*Attorney, Agent, or Firm*—Pearne, Gordon, Sessions, McCoy, Granger & Tilberry

[57] ABSTRACT

A method of making swimming pool walls with gutter and conduit constructions from sheet metal components that are fused together at welded junctions. The method is characterized by forming the individual components to specific configurations that are adapted for sequential assembly on a supporting structure. The configurations of the individual components are such that when assembled three of the components are fused together at a continuous single weld to effect a water tight closure for the gutter and conduit. This results in the elimination of one continuous welded seam and also simplifies the fabrication and assembly of the construction. The present method is further characterized by being adaptable to form a plurality of gutter and conduit types and capacities from standardized main components. In addition, the method is adapted to effect closer tolerances in alignment of the components during the assembly and welding thereof.

5 Claims, 20 Drawing Figures

SWIMMING POOL WALLS WITH GUTTER AND CONDUIT CONSTRUCTION

BACKGROUND OF THE INVENTION

This invention relates to swimming pool walls, gutter and conduit constructions, and more particularly to a novel method for assembling such constructions from sheet metal components of unique configuration.

PROBLEMS IN THE ART

It is the present practice in the art to fabricate swimming pool walls, gutters, and water delivery conduits as unitary constructions which are assembled from stainless steel sheet metal components.

Problems have been present in the fabrication of such prior constructions in that the sheet metal components used have here to for been fabricated in shapes not adapted for ease and economy of assembly at the pool site. More particularly such prior constructions have generally included components that inherently preclude the welder from having access to perform continuous welding internally of the gutter and conduit construction during assembly. Hence, external welded seams were required with resulting rough welds on the exposed pool face that required expensive grinding and polishing operations.

As another problem, prior constructions included components which were configurations which precluded standardization of the shape and size of any of the components.

Another problem was present with prior methods of assembly in that close tolerance in the alignment of components could not be maintained during the formation of the above mentioned continuous welds. Hence, wavy and unaligned pool faces often were the result.

SUMMARY OF THE INVENTION

In general, the present invention comprises a novel method of making swimming pool walls and gutter and conduit constructions from sheet metal components that are assembled in a unique sequence and fused together at continuous welded junctions to effect watertight closure of the gutter and conduit portions of the construction.

More particularly, in accordance with the present method, the individual sheet metal components are uniquely shaped and sequentially assembled on a supporting structure. In some instances where the pool wall is formed of sheet metal, as part of the assembly, such supporting structure consists of buttresses or steel frames located at spaced intervals along the wall location. In other instances where the pool wall is formed of concrete, the concrete wall serves as the supporting structure.

As one aspect of the present invention the sheet metal components are formed to specific shapes such that they can be assembled on the supporting structure in a gutter an conduit forming configurations with three of such components, each having longitudinal edge positioned at a common ajoining location, so as to form a three edge junction of the components. This junction is fused with a single continuous weld to effect a watertight closure for the gutter and conduit construction. This results in the elimination of one continuous welded seam and also simplifies assembly of the system.

As another aspect of the present invention, the novel method is uniquely adapted to selectively form a plurality of gutter and conduit types of selectively variable capacities from main components which are standardized with respect to size and shape. Hence, the job to job variations in gutter type and conduit capacity can easily be accomodated by minor variations in the size of secondary components.

As another aspect of the present invention, the novel method includes a unique jig type assembly members of the sheet metal components using brace members, so as to greatly minimize warpage during the fuse welding of the components.

As another aspect of the present invention, the present method uniquely effects a high degree of alignment of the individual sheet metal components and hence a straight finished wall assembly. These important benefits result from the novel sequential assembly of the specifically shaped and oriented sheet metal components, which include alignment flanges that can be precisely positioned and clamped, so as to establish close tolerances of alignment during assembly, as well as maintain such tolerances during continuous welding operations.

As another aspect of the present invention, the present method in certain of its embodiments, employs a unique sequence of assembly wherein a continuous welded junction in the pool face can be made internally of the conduit and hence hidden from view from the pool face side. As a result, the requirement of grinding and excessive polishing of the welded junction is eliminated.

As another aspect of the present invention, the method utilizes sheet metal components formed to specific configurations such that one of two previously mentioned standard main components i.e. a gutter wall component that forms only gutter wall portions of the assembly, can, if desired, be fabricated from sheet metal of lighter gauge, than the gauge required for the other components that form the water delivery conduit. Since industry standards require that only the conduit be formed from of at least twelve gauge sheet metal, said gutter wall component can be formed of lighter fourteen gauge material, thereby effecting a cost savings of approximately ten percent.

As another aspect of the present invention novel pool wall, gutter and conduit constructions are fabricated from uniquely shaped sheet metal components adapted to be assembled with a minimum of continuous welded junctions.

As still another aspect of the present invention the uniquely shaped sheet metal components comprise main components that are of standard or fixed size and shape but which can be selectively used in a plurality of different gutter, conduit, and wall configurations.

Further objects and advantages of the present invention will be apparent from the following description, reference being had to the accompanying drawings wherein a preferred form of embodiment of the invention is clearly shown.

DESCRIPTION OF THE PREFERRED EMBODIMENT

Figure 1:
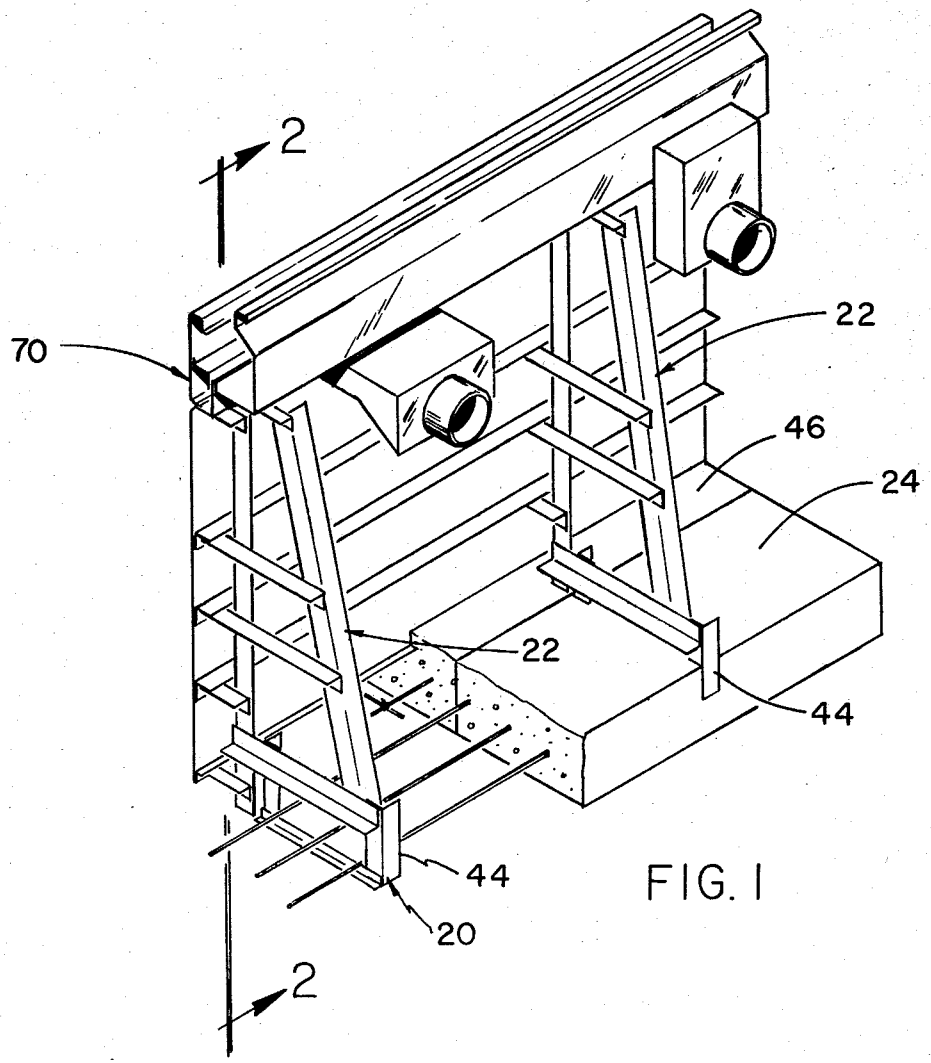
FIG. 1 is a perspective view showing a typical swimming pool wall, gutter, and conduit construction fabricated in accordance with the method of the present invention.

Referring in detail to the drawings, FIG. 1 illustrates a pool wall construction fabricated in accordance with the present invention. This construction includes a supporting means indicated generally at 20. In this embodiment the supporting means is formed by a plurality of buttresses indicated generally at 22 which are mounted at spaced intervals on a poured reenforced concrete footer 24.

Each of the buttresses 22 includes upright frame members 26 and 28 and horizontal frame members 30, 32, 34, 36, 38, 40 and 42. These frame members are best seen in FIG. 2 which is a wide sectional view taken along a vertical plane through the wall construction of FIG. 1.

Figure 2:
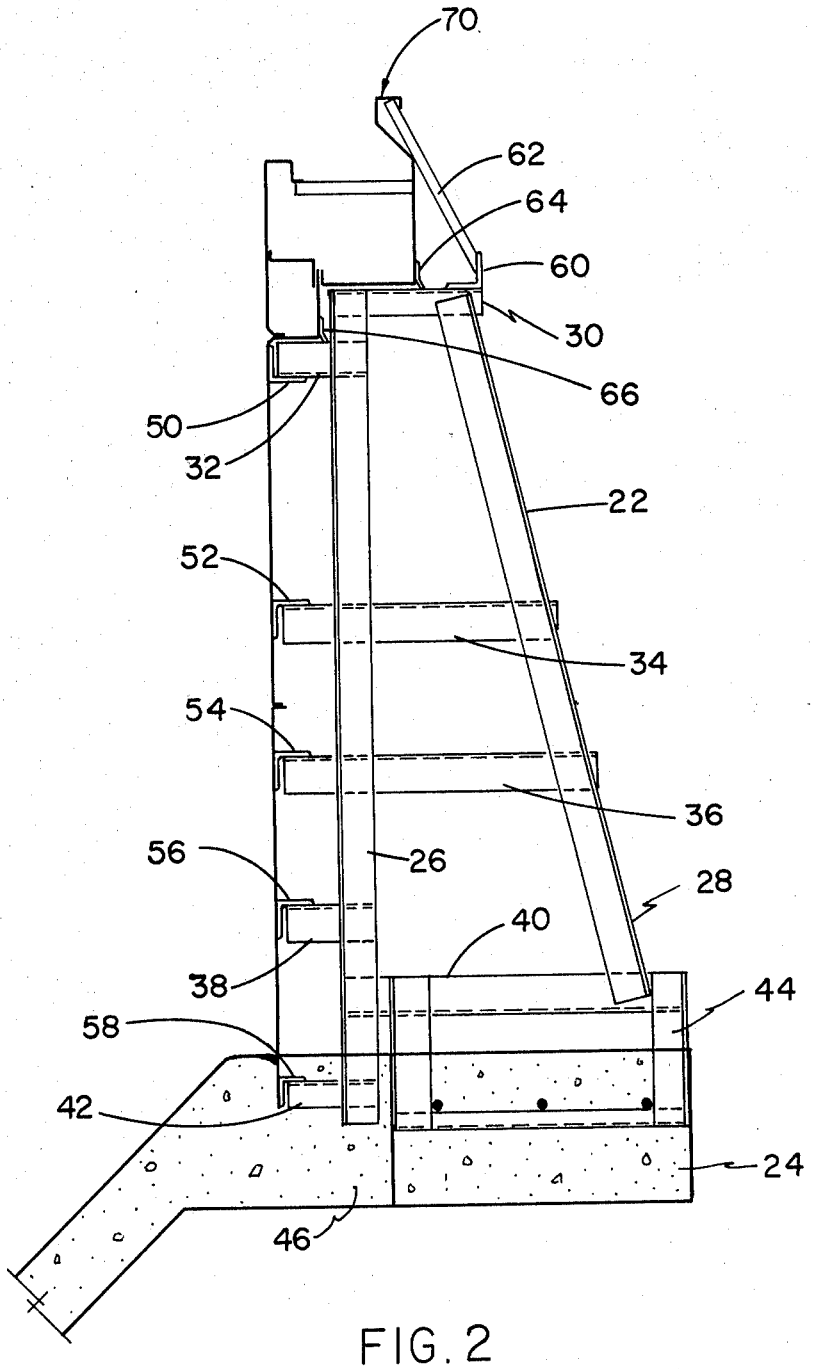
FIG. 2 is a sectional view of the construction of FIG. 1 with the section being taken along line 2—2 of FIG. 1.

With continued reference to FIG. 2, each buttress 22 is mounted at its base to concrete footer 24 by welding frame member 40 of the buttress to a u-shaped buttress anchor 44 which anchor is imbedded in the footer when it is poured.

It will be noted from FIGS. 1 and 2 that a pool bottom 46 is formed of poured reenforced concrete, so as to ajoin footer 24.

Referring again to the buttress structure shown in FIGS. 1 and 2, a plurality of pool face stringers 50, 52, 54, 56 and 58 are welded to the inner ends of the horizontal frame members. Also, a brace supporting clip 60 is welded on the outer end of each top horizontal frame member 30 to provide a base mount for the lower end of a gutter alignment brace member 62. A gutter alignment clip 64 and a conduit alignment clip 66 are respectively mounted on horizontal frame members 30 and 32. These clips are used in the assembly of the construction in a manner later to be described.

THE CLOSED GUTTER POOL TYPE METAL WALL EMBODIMENT

Figure 3:
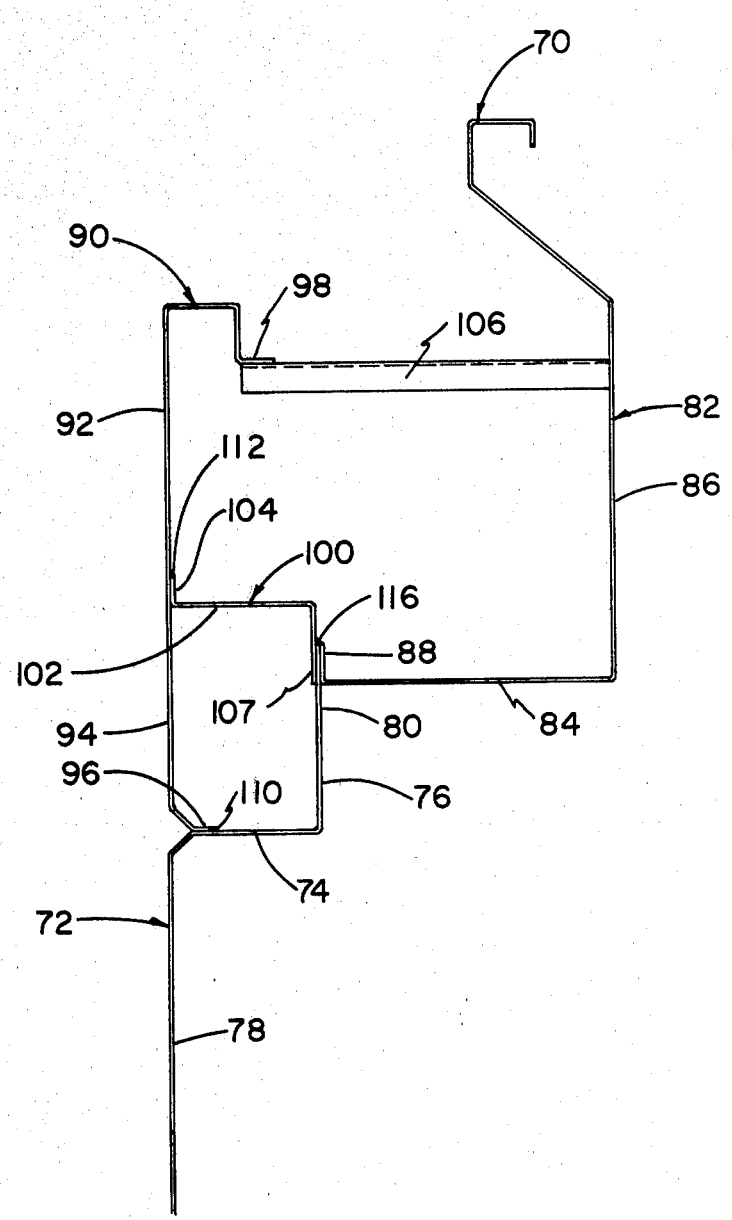
FIG. 3 is an enlarged sectional view showing details of the gutter and conduit portion of the construction of FIG. 2.

This embodiment constructed in accordance with the present method is illustrated in FIGS. 1 and 2, just described, with the components of the construction being shown in enlarged detail in FIG. 3. The steps in the sequence of assembly are progressively illustrated in FIGS. 4 through 7.

As best seen in FIG. 3, this embodiment comprises a pool wall, gutter and conduit construction indicated generally at 70, which construction consists of a welded assembly of four sheet metal components. A conduit bottom wall component is indicated generally at 72, and includes a conduit bottom wall 74, a conduit outer wall 76, a pool wall 78, and an outer edge 80.

The next component, FIG. 3, will be referred to herein as the gutter wall component, indicated generally at 82, and consisting of a gutter bottom wall 84, gutter outer wall 86, and inner edge 88.

A third sheet metal component, referred to herein as a pool face component 90, forms a gutter inner wall 92, a conduit inner wall 94 and includes a lower edge 96 and an upper edge 98.

The fourth sheet metal component, FIG. 3, referred to herein as a conduit closure component 100, forms conduit top wall 102 and includes an inner edge 104 and an outer edge 107.

The construction of FIG. 3 also includes a plurality of horizontal brace members 106 which are used for alignment purposes during assembly, as later described and also serves to support a removeable screen closure, not illustrated.

Reference is next made to FIGS. 4–7, which sequentially illustrate the steps in the present method used in the assembly of the closed gutter pool wall embodiment.

Figure 4:
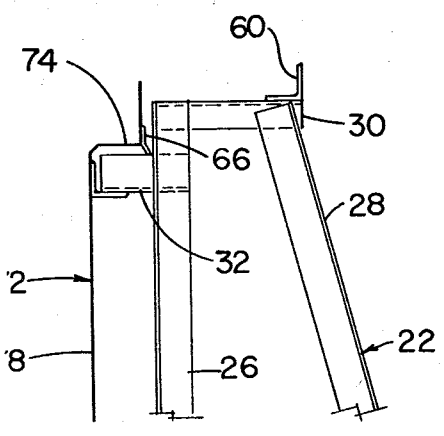

As seen in FIG. 4 after the buttresses 22 are erected on footer 24 conduit bottom wall component 72 is positioned on the buttresses with conduit bottom wall portion 74 overlying top supporting surfaces on frame members 32 and with pool face portion overlying the stringers 50–58 that define the pool face. Component 72 is clamped and tack welded in place using the conduit alignment clips 66 as connectors between the component and the underlying frame member.

It should be mentioned that components 72, 82, 90 and 100 are in common practice formed in ten foot lengths and used with five foot buttress spacings. The vertical edges of the assembled construction are fused by continuous welds.

Figure 5:
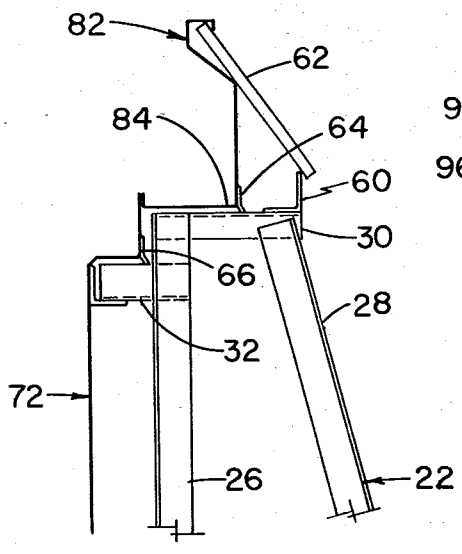

Referring next to FIG. 5, a gutter wall component 82 is next assembled on the buttress with gutter bottom wall portion overlying a horizontal supporting surface formed by top frame member 30. Component 82 is clamped and tack welded in place using gutter alignment clips 64 and gutter brace members 62. These clips and brace members are tack welded in place as required to establish longitudinal alignment of gutter component 82 throughout its ten foot longitudinal extent.

Figure 6:
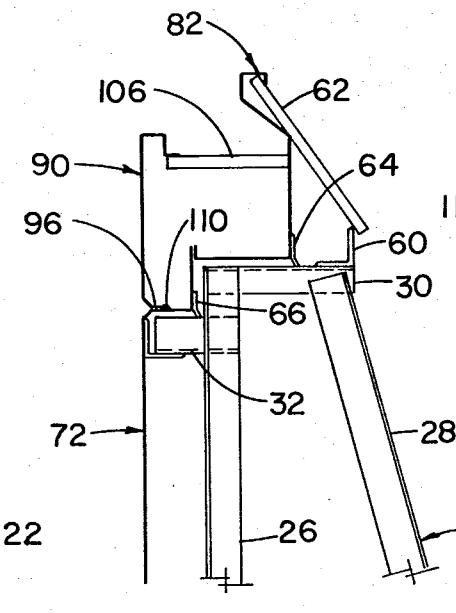

As will be seen in FIG. 6, a pool face component 90 is next added to the assembly with a bottom edge 96 resting on component 72. The components are clamped and tack welded along 96 and horizontal brace members 106 are tack welded at one end to top edge 98 of pool face component and at the other end to gutter wall component 82.

The next step in the sequence of assembly is to form a continuous weld 110 to form a water tight seal along the junction of bottom edge 96 and bottom wall component 72. This continuous weld 110 can hence be formed as a hidden weld with respect to the pool face and hence need not be polished to a high finish as would be required if it were exposed to swimmers.

Figure 7:
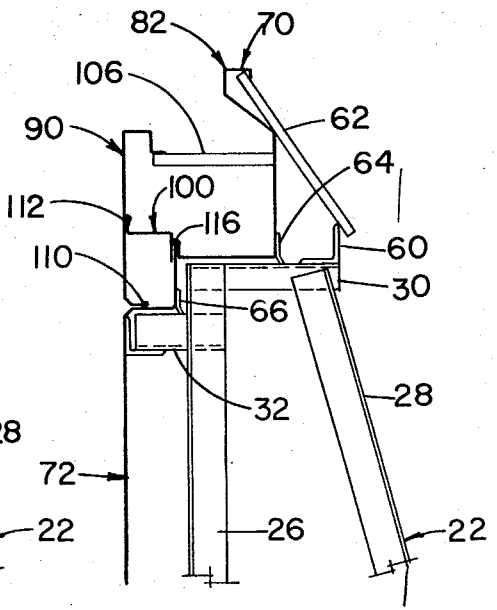
FIGS. 4 through 7 are sequential assembly views illustrating steps in the assembly of one embodiment constructed in accordance with the method of the present invention.

Referring next to FIG. 7, the last component to be installed, is conduit closure means 100 which in this embodiment forms the top wall of the conduit. Component 100 is first clamped and tack welded in position with inner edge 104 engaging the outer surface of the pool face component 90 and with outer edge 107 forming a three component junction with outer edge 80 of component 72 and inner edge 88 of component 82.

The final steps in assembly of the construction 70 consists of forming continuous welds 112 and 116 to form water tight seals between the conduit and the gutter.

It will now be understood that the four component construction of FIGS. 1 through 7 requires only three continuous welds 110, 112, and 116. Hence, at least one continuous weld is eliminated, as compared to prior construction, which results in a substantial savings in time and material.

THE CLOSED GUTTER TYPE CONDUIT AND GUTTER CONSTRUCTION

Reference is next made to FIGS. 8–12 which illustrate a second embodiment constructed in accordance with the present invention.

Figure 8:
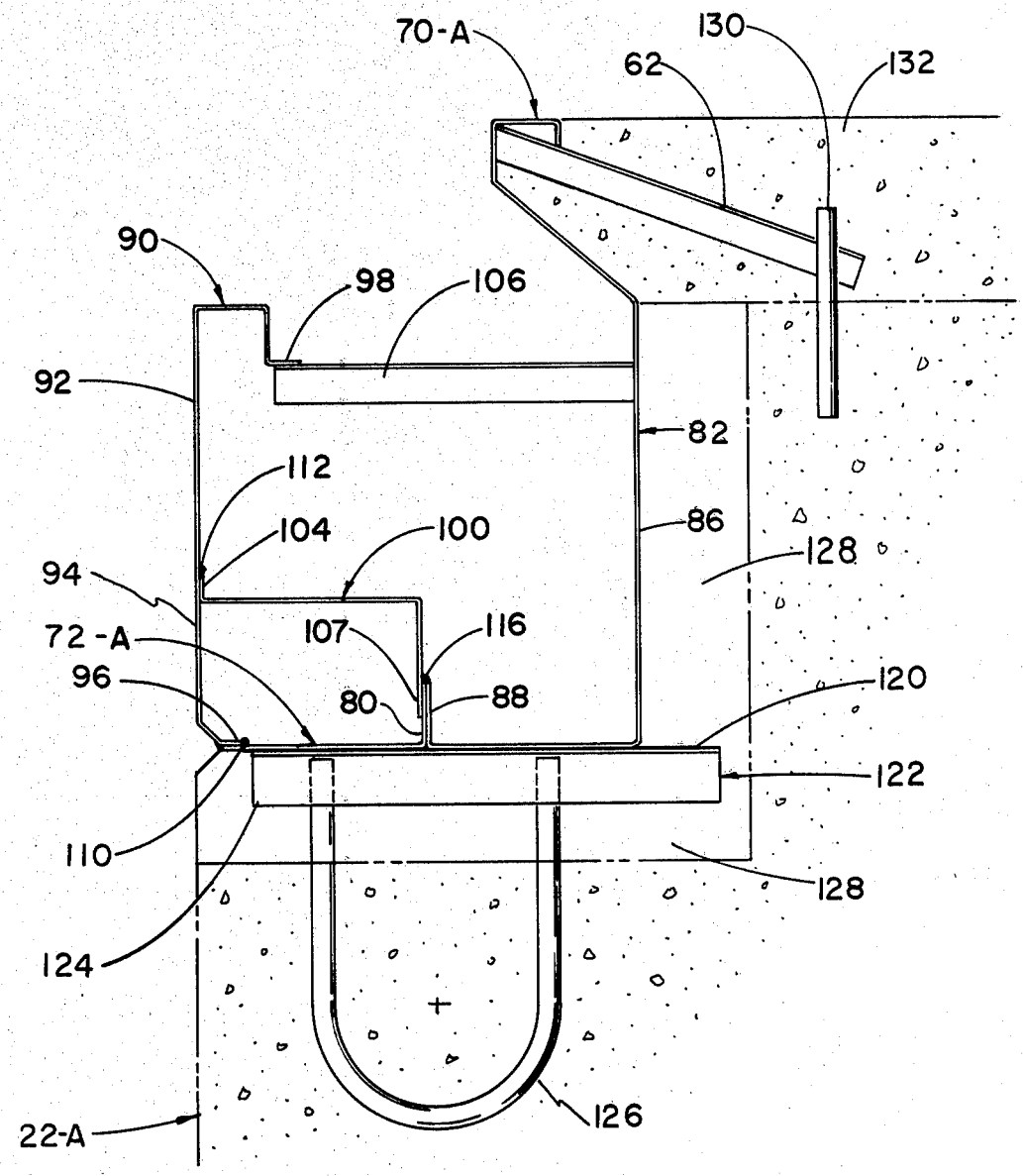
FIG. 8 is an enlarged sectional view of a second embodiment constructed in accordance with the method of the present invention.

In this embodiment a poured concretewall 22-A forms the supporting means for a gutter and conduit construction indicated generally at 70-A. The upwardly facing supporting surface 120 is formed by an anchor assembly 122 consisting of steel angle 124 and steel U-shaped rod 126 with the latter being imbedded in poured concrete supporting means 22-A. As seen in FIG. 8, a layer of grout 128 is provided between the bottom of construction 70-A and the top surface of concrete supporting means 22-A, so as to provide a water tight seal.

As is best seen in FIG. 8, this embodiment comprises a gutter and conduit construction indicated generally at 70-A which construction again consists of a welded assembly of four sheet metal components. Here only the conduit bottom wall component 72-A differs from the corresponding component 72 in the prior embodiment of FIGS. 1–7.

The other three components again consist of a gutter wall component 82, a pool face component 90, and a conduit closure component 100 with these three components being identical to the corresponding components of the first embodiment of FIGS. 1–7.

Reference is next made to FIGS. 9–12 which sequentially illustrate the steps in the present method used in the assembly of the closed gutter type of FIG. 8.

Figures 9, 10, 11, 12:
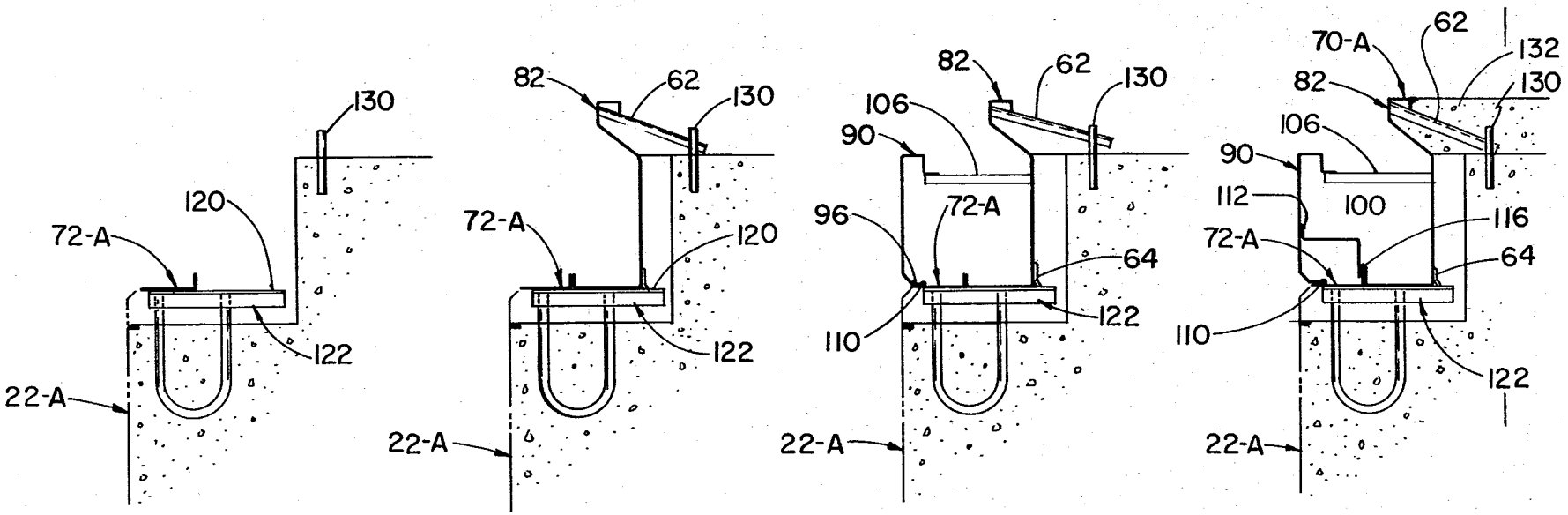
FIGS. 9 through 12 are sequential assembly views illustrating steps in the assembly of second embodiment constructed in accordance with the method of the present invention.

As seen in FIG. 9, after concrete wall 22-A is erected with anchor assemblies 122 located at spaced intervals, and prior to the application of the layer of grout 128, conduit bottom wall component 72-A is positioned on supporting surfaces 120 and aligned with the pool wall face. Component 72-A is then clamped and tack welded in place.

Referring next to FIG. 10, gutter bottom wall component 82 is then positioned on supporting surfaces 122 with inner edge 88 aligned with and engaging outer edge 80 of conduit bottom wall component 72-A. Component 82 is next clamped and tack welded along the junction of edges and a plurality of gutter brace members are installed at spaced intervals, so as to align gutter outer wall 86 to a straight configuration, as well as to maintain such alignment during subsequent welding operations. The brace members are tack welded at one end to top of gutter wall component 82 and at the other end to an exposed top end of a steel rod 130 imbedded in the concrete.

With reference to FIG. 11, a pool face component 90 is next positioned on component 72-A, so as to be aligned with the inner face of wall 22-A. Component 90 is clamped and tack welded at its lower end 96 with horizontal brace members 106 being installed at spaced intervals, so as to align the top edge of pool wall component 82 and maintain a streight configuration during subsequent welding operations. Brace members 106 are welded at one end to top edge 98 of component 90 and at the other end to the inner surface of gutter wall component 82.

Referring again to FIG. 11, the next step in the sequence of assembly is the formation of a continuous weld 110 as previously described herein in the description of FIG. 6 of the previous embodiment.

Referring next to FIG. 12, a conduit closure component 100 is next installed in the same manner as set forth in the description of FIG. 7 which relates to the previous embodiment.

Referring next to FIG. 12, a conduit closure compoent 100 is next installed in the same manner as set forth in the description of FIG. 7 which relates to the previous embodiment.

Continuous welds 112 and 116 are then installed to provide the water tight seams between the conduit and the gutter. The pool wall is completed by applying the layer of grout 126 between the metal components and the concrete wall, and by pouring the concrete pool deck around the perimeter of gutter wall component 82.

THE OPEN GUTTER TYPE POOL WALL EMBODIMENT

Reference is next made to FIGS. 13–16 which illustrate a third embodiment constructed in accordance with the method of the present invention.

This embodiment, like the embodiment of FIGS. 1–7, is used where a metal pool wall is desired and hence is mounted on a metal frame or buttress similar to the one shown in FIGS. 1 and 2.

Figure 13:
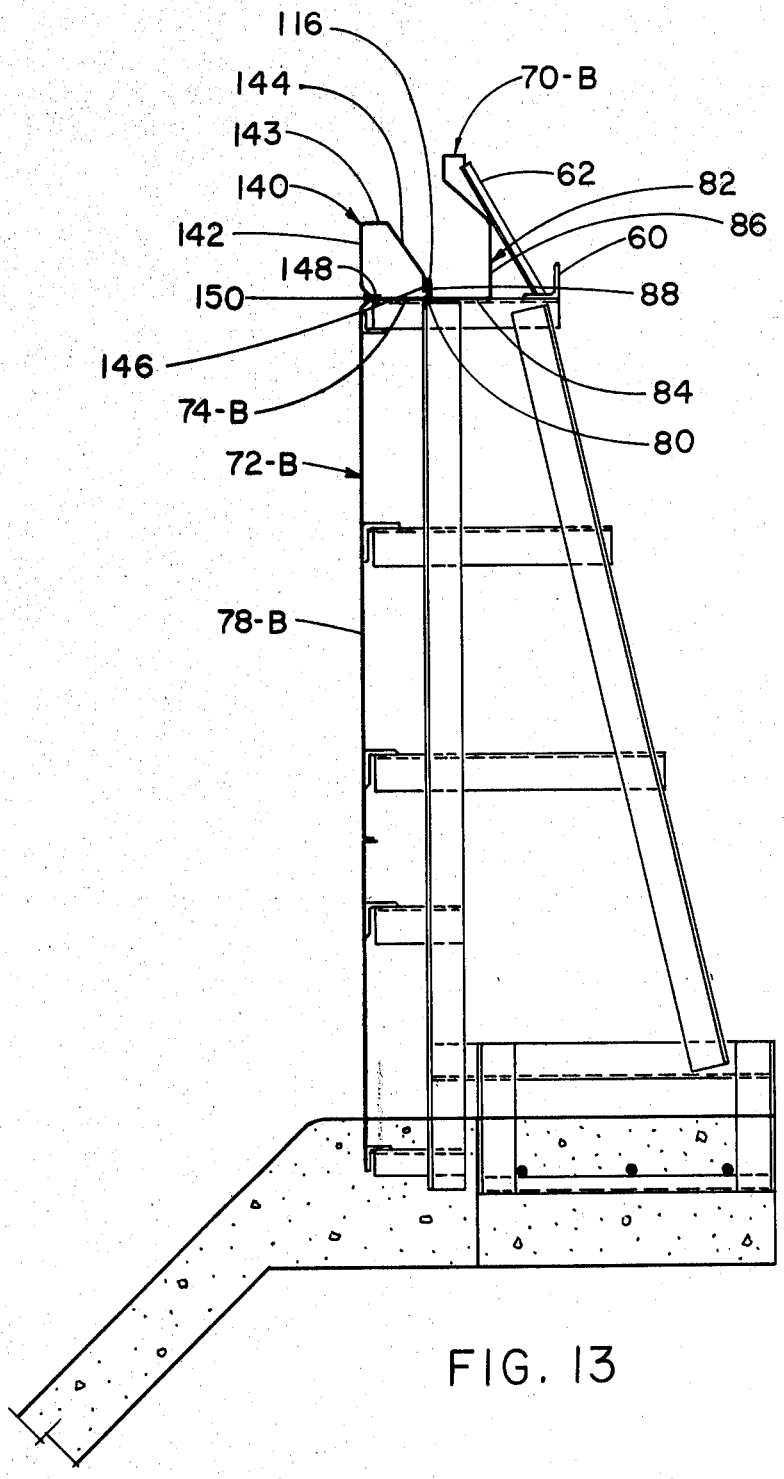
FIG. 13 is an enlarged sectional view of a novel third embodiment constructed in accordance with the method of the present invention.

As is best seen in FIG. 13, this open gutter construction 70-B comprises a gutter, conduit and pool wall construction made from only three sheet metal components joined together with only two continuous welds 116 and 150.

A conduit bottom Wall component 72-B includes a pool wall portion 78-B and a gutter bottom wall portion 74-B. Component 72-B differs from component 72, FIGS. 1–7, in that it does not include an upstanding conduit outer wall portion 76. The method of assembly of these two conduit bottom wall components are, however, similar and in accordance with the method of the present invention.

Referring again to FIG. 13, gutter wall component 82 is identical to the corresponding component in the preceeding two constructions 70 and 70-A.

The third component, FIG. 13, consists of a conduit closure component 140 which serves the multiple function of forming a conduit inner wall 142, a conduit top wall 143, and a conduit inner wall 144.

As seen in FIG. 13, all three components are joined together at continuous weld 116 which weld forms a three component junction in the same manner as the corresponding weld 116 used in the previous embodiment.

Figure 16:
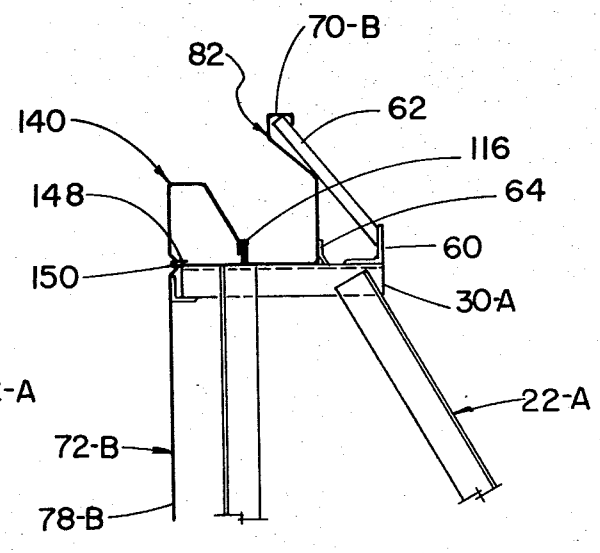
FIGS. 14 through 16 are sequential assembly views illustrating steps in the assembly of a third embodiment constructed in accordance with the method of the present invention.
Figure 15:
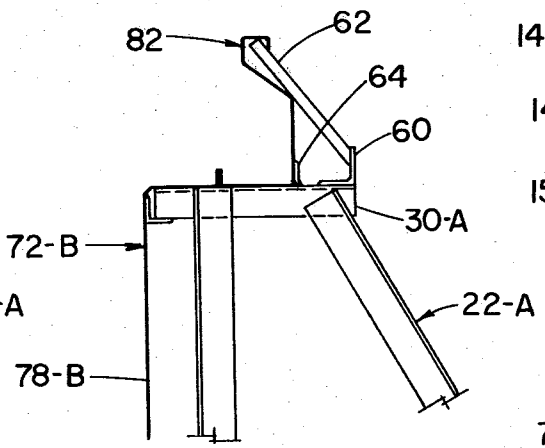
Figure 14:
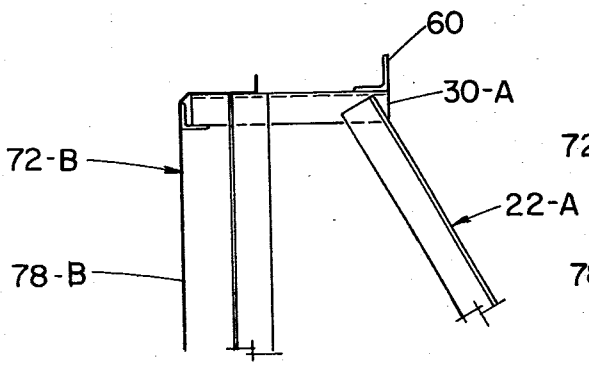

Reference is next made to FIGS. 14-16 which sequentially illustrate the steps in the method of assembling the open gutter construction of FIG. 13. The previously described components are assembled on a modified buttress 22-A which includes a modified upper horizontal frame member 30-A which forms a supporting surface for both the conduit bottom wall 74-B and the gutter bottom wall 84 which walls are co-planar. Hence, the horizontal frame member 32 included in the buttress 22 is not required in the embodiment 70-B of FIG. 13.

Referring particularly to the assembly views of FIGS. 14 and 15, conduit bottom wall component 72-B and gutter bottom wall component 82 are installed in the same manner as previously described in connection with the installation of the corresponding members 72 and 82 shown in FIGS. 4 and 5.

With reference to FIG. 16, the third and last sheet metal component which is conduit closure component 140 is aligned, clamped and spot welded in position, FIG. 16, with an inner edge 148 resting on conduit bottom wall component 72-B and in alignment with pool wall 78-B, and with an outer edge 146 engaging inner edge 80 of conduit bottom wall component 72-B. Here again a three component junction is formed which is joined by a continuous weld 116 in the same manner as the previous embodiments.

The construction of FIG. 16 is completed by a second continuous weld 150 on the pool face side at the junction of inner edge 148 and gutter bottom wall component 72-B.

THE OPEN GUTTER TYPE CONDUIT AND GUTTER CONSTRUCTION

Reference is next made to FIGS. 17-20 which illustrates a fourth embodiment in accordance with the present invention.

This construction indicated generally at 70-C is used where an open gutter type is to be combined with a poured concrete pool wall. Hence, as was the case with the construction of FIGS. 8-12, the upwardly facing supporting surface 120 is formed by anchor assembly 122 imbedded in concrete wall 22-A as previously described.

Figure 17:
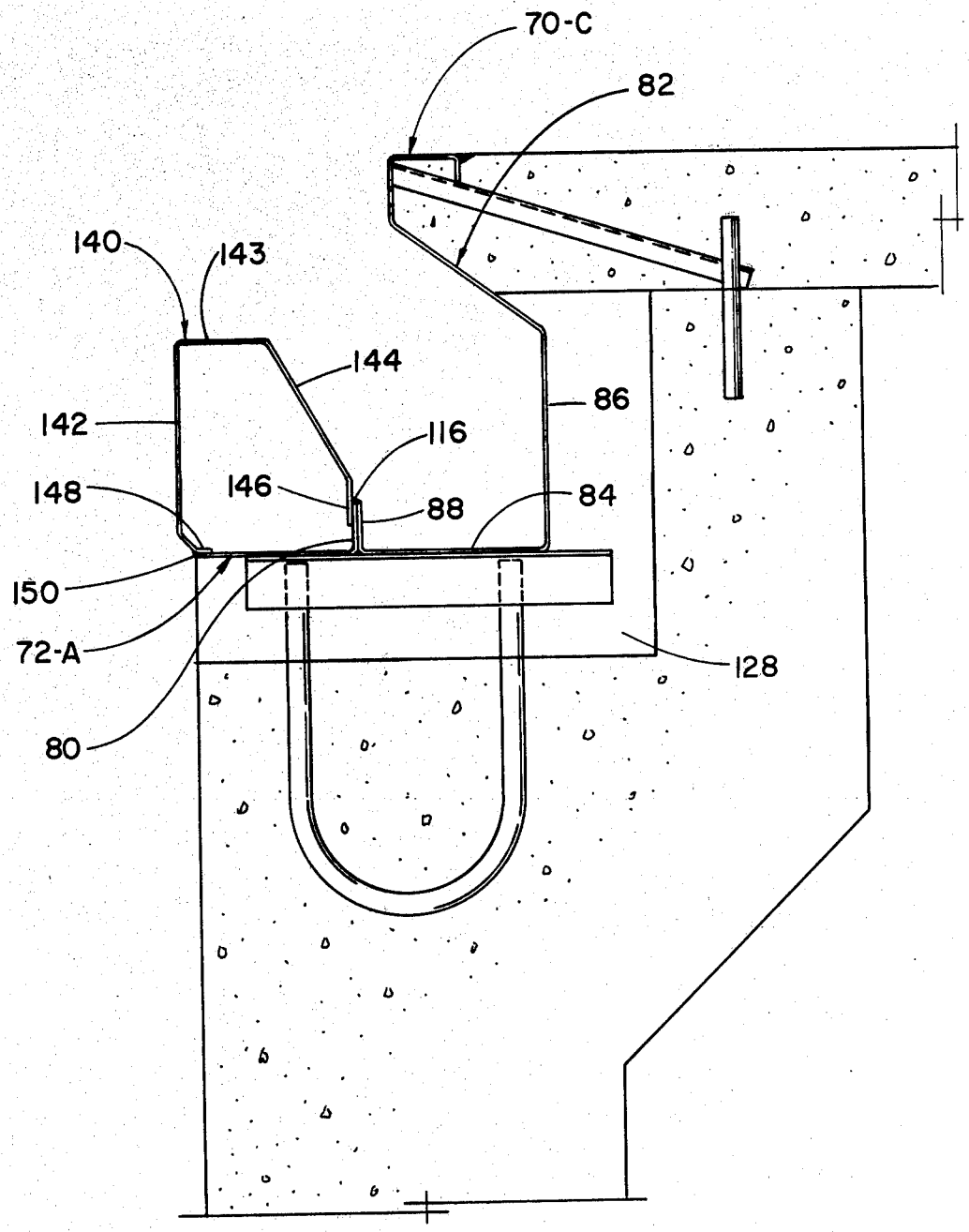
FIG. 17 is an enlarged sectional view of a fourth embodiment constructed in accordance with the method of the present invention.

As is best seen in FIG. 17, construction 70-C consists of a gutter and conduit construction made from only three sheet metal components, the assembly of which requires only two continuous welds forming water tight seals for the water delivery conduit.

The conduit bottom wall component 72 is the same component used in the construction of FIGS. 8-12 and the gutter wall component 82 is identical to the corresponding component in all of the other three embodiments. Conduit closure component 140 is identical to the conduit closure of the other open gutter embodiment of FIGS. 17-20 just described.

Figure 20:
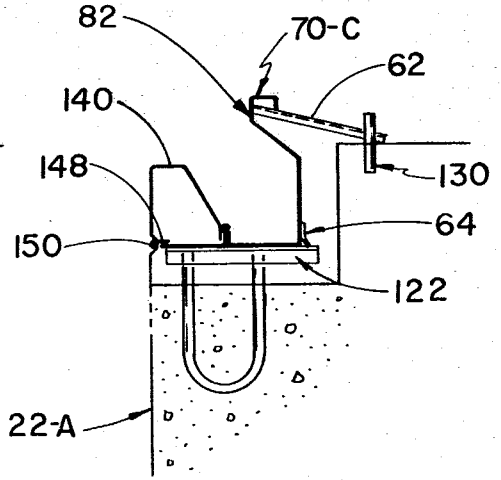
FIGS. 18 through 20 are sequential assembly views illustrating steps in the assembly of fourth embodiment constructed in accordance with the method of the present invention.
Figure 19:
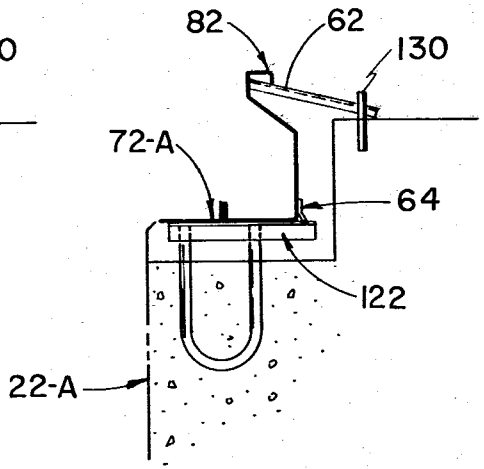
Figure 18:
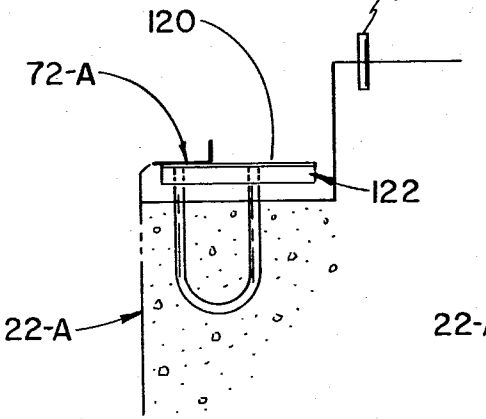

Referring next to the assembly views of FIGS. 18-20, the first two components 72-A and 82 are assembled on anchor assemblies 122 in the same manner previously set forth in the description of FIGS. 9 and 10 which illustrate the other concrete wall embodiment.

As seen in FIG. 20, construction 70-C is completed by installation of conduit closure component 140 which is effected in the same manner set forth in the description of the other concrete embodiment shown in FIGS. 8-12.

It should be pointed out that in the descriptions of all four embodiments the sequences described herein set forth first the erection of the conduit bottom wall component such as component 72 and second, the erection of the gutter wall component such as component 82. It should be mentioned that although this is the preferred sequence the two steps can be reversed with respect to these two main components with the gutter wall component 82 being the first component installed on the supporting means followed by the erection of the conduit wall component 72.

We claim:

1. A swimming pool wall construction comprising, in combination, a supporting means defining a pool wall location; a plurality of sheet metal components assembled on said supporting means and forming a gutter and conduit assembly said sheet metal components comprising, in combination, a gutter wall component on said supporting means and forming a gutter outer wall portion, a gutter bottom wall portion, and an upturned flange forming a gutter wall component inner edge portion; a conduit bottom wall component on said supporting means and forming a conduit bottom wall portion and an upturned outer flange forming a conduit bottom wall component outer edge portion; a conduit closure component forming a conduit top closure portion and a downturned outer flange forming a conduit closure outer edge portion, said first and second upturned flanges and said downturned outer flange being positioned in ajoining relationship at a three component junction for said gutter wall component, said conduit bottom wall component and said conduit closure component; and a single continuous weld joining the three component junction for joining together said gutter wall component, said conduit bottom wall component, and said conduit closure component, said single continuous weld forming a water tight seam between the conduit and the gutter.

2. The pool wall construction defined in claim 1 wherein said conduit bottom wall component includes a vertical pool wall portion extending downwardly along the supporting means.

3. A swimming pool wall construction comprising, in combination, a supporting means defining a pool wall location; a plurality of sheet metal components assembled on said supporting means and forming a gutter and conduit assembly, said sheet metal components comprising, in combination, a gutter wall component on said supporting means and forming a gutter outer wall, a gutter bottom wall portion, and an upturned flange forming a gutter wall component inner edge portion; a conduit bottom wall component on said supporting means and forming a conduit bottom wall portion and an upturned outer flange forming a conduit bottom wall component outer edge portion; a pool face component on said supporting means and forming a gutter inner wall and a conduit inner wall and including a pool face component lower edge portion welded to said conduit bottom wall component to form a water tight seam between the conduit and the pool; a conduit closure component forming a conduit top closure portion, a downturned outer flange forming a conduit closure outer edge portion and conduit inner edge portion welded to said pool face component, said first and second upturned flanges and said downturned outer flange being positioned in ajoining relationship at a three component junction for said gutter wall component, said conduit bottom wall component and said conduit closure component a single continuous weld joining the three component junction for joining together said gutter wall component, said conduit bottom wall component, and said conduit closure component, said single continuous weld forming a water tight seam between the conduit and the gutter.

4. The pool wall construction defined in claim 3 wherein the water tight seam between the conduit and the pool is formed by a continuous weld located within the conduit.

5. The pool wall construction defined in claim 4 wherein said conduit bottom wall component includes a vertical pool wall portion extending downwardly along the supporting means.

* * * * *